US005809886A

United States Patent [19]

Faber

[11] Patent Number: 5,809,886

[45] Date of Patent: Sep. 22, 1998

[54] SELF-INKING STAMP

[75] Inventor: Ernst Faber, Wels, Austria

[73] Assignee: Colop Stempelerzeugung Skopek GmbH & Co. KG, Wels, Austria

[21] Appl. No.: 782,450

[22] Filed: Jan. 13, 1997

[30] Foreign Application Priority Data

Jan. 24, 1996 [AT] Austria ..... 33/96

[51] Int. Cl.[6] ..... B41K 1/08

[52] U.S. Cl. ..... 101/334; 101/372

[58] Field of Search ..... 101/334, 333, 101/368, 372, 373

[56] References Cited

U.S. PATENT DOCUMENTS

| | | | |
|---|---|---|---|
| 280,652 | 7/1883 | Moise | 101/334 |
| 752,771 | 2/1904 | Hardy | 101/373 |
| 1,064,455 | 6/1913 | Dodge | 101/372 |
| 2,143,833 | 1/1939 | Moss | 101/379 |
| 3,030,605 | 4/1962 | Carissimi | 174/53 |
| 4,432,281 | 2/1984 | Wall et al. | 101/334 |
| 5,517,916 | 5/1996 | Dour et al. | 101/334 |

FOREIGN PATENT DOCUMENTS

| | | | |
|---|---|---|---|
| 384999 | 7/1987 | Austria . | |
| 70936 | 2/1983 | European Pat. Off. . | |
| 5-181272 | 7/1993 | Japan . | |
| 182745 | 2/1936 | Switzerland . | |
| 22711 | 7/1914 | United Kingdom | 101/368 |
| 398754 | 9/1933 | United Kingdom . | |
| 921189 | 3/1963 | United Kingdom . | |

*Primary Examiner*—Edgar S. Burr
*Assistant Examiner*—Daniel J. Colilla
*Attorney, Agent, or Firm*—Collard & Roe, P.C.

[57] ABSTRACT

In the self-inking stamp described which includes a self-inking device, an inverting mechanism and a stamp plate fastened to a stamp plate carrier, the stamp plate is releasably connected with the stamp plate carrier via at least one male projection received in a corresponding recess in the stamp plate carrier. An assortment of such stamp plates may be held available in a stamp plate set with a plug-in holder.

34 Claims, 2 Drawing Sheets

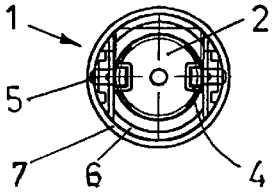
FIG.2
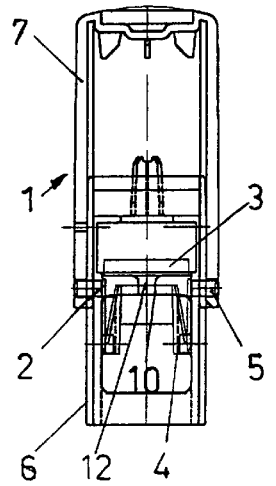
FIG.1
FIG.3
FIG.4
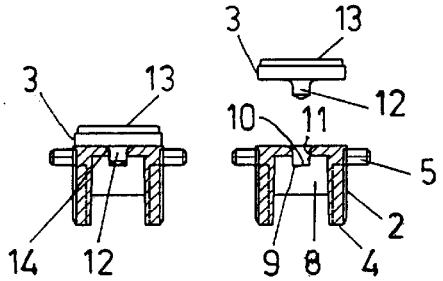
FIG.6
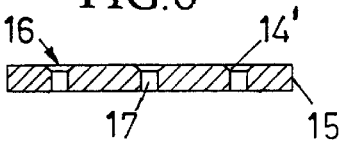
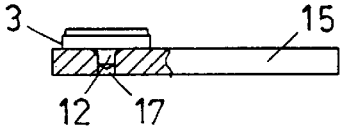
FIG.8
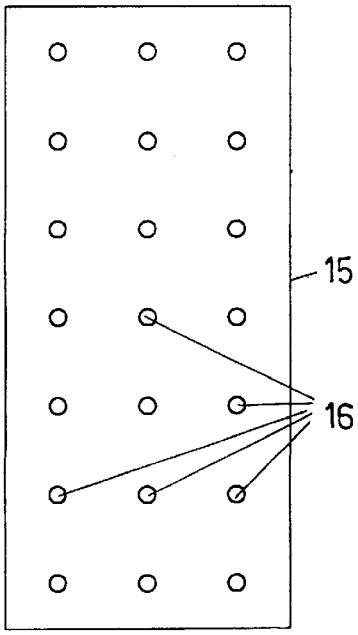
FIG.5
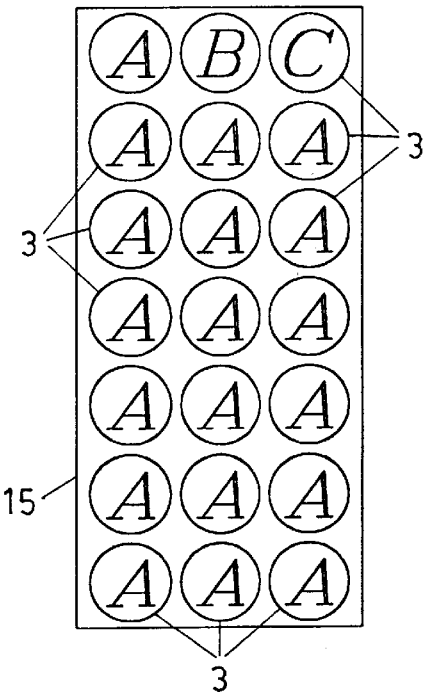
FIG.7

SELF-INKING STAMP

FIELD OF THE INVENTION

The invention relates to a self-inking stamp comprising a self-inking device, an inverting mechanism coupled with a movable stamp plate carrier, and a stamp plate attached to the stamp plate carrier.

Furthermore, the invention relates to a stamp plate to be attached to a stamp plate carrier of such a self-inking stamp.

Finally, the invention also relates to a stamp plate set comprising a plurality of such stamp plates.

DESCRIPTION OF THE PRIOR ART

Simple hand stamps without a self-inking device and thus without movable parts, but with exchangeable stamp plates are known from U.S. Pat. No. 752,771 A and GB 921,189 A, e.g. In the hand stamp according to U.S. Pat. No. 752,771 A which serves for simultaneously making several prints on the sole portions of hosiery, stamp parts having block-shaped projections are fixed in holding plates, with clamping screws laterally screwed into the holding plates being tightened. On the other hand, GB 921,189 A describes a simple hand stamp provided as a children's toy, in which printing blocks are exchangeably mounted on a one-piece grip-holder member by inserting studs in apertures in the grip-holder member. To improve the press-fit of the studs in the apertures, these apertures are extended by annular bosses on the rear side of the grip-holder member so as to provide a larger area of friction. Besides, in view of its use by children, who must be able to readily exchange the printing blocks, too tight a fit of the stamp plate is not desirable.

In simple hand stamps comprising fixed printing characters or stamp plates, however, the latter usually are simply fixedly attached to a stamp plate carrier, in particular glued thereto, cf. U.S. Pat. No. 2,143,833 A and CH 182,745 A, and this is even the more true for self-inking stamps having a movable stamping unit which is to be inverted, cf. U.S. Pat. No. 4,432,281 A, since there, as compact, small and solid a configuration of this stamping unit as possible had to be sought because of the limited space available and the movable arrangement of the stamp unit.

What is detrimental with this manner of attaching the stamp plate to the stamp plate carrier is that the respective stamp is unchangeably designed for a certain stamp print, any desired later change no longer being possible; thereinstead, a new stamp having the desired different printing block must be procured. With self-inking stamps this is an even greater disadvantage because on account of the self-inking device with the inverting mechanism, the stamp on the whole is comparatively complex and expensive.

It is an object of the invention to provide a self-inking stamp of the previously defined type, in which it is possible in a simple manner to choose and vary the printing block, i.e. the stamp plate, as required, so that, e.g., also at the time of buying a self-inking stamp, it is possible to choose the desired stamp plate from an assortment, or that also after a self-inking stamp has been bought, the user can, at a later date, exchange the existing stamp plate for another one.

It is a further object of the invention to provide a subsequently insertable or exchangeable stamp plate, respectively, which is easy to produce, for such a self-inking stamp.

It is also an object of the invention to provide a stamp plate set comprising a plurality of such stamp plates so as to enable a seller or also a user to choose the respective desired stamp plate from a well-arranged assortment thereof and to insert it in the respective hand stamp in a simple manner.

SUMMARY OF THE INVENTION

According to the invention, the self-inking stamp of the initially defined type, with the movable stamp plate carrier, comprises a stamp plate which is detachably connected with the stamp plate carrier via at least one plug-in connection element.

Correspondingly, the stamp plate according to the invention has at least one plug-in connecting element to be releasably connected with the stamp plate carrier.

The present invention thus is based on the idea that the stamp plate which may be of a softer material, as compared to the stamp plate carrier, in particular of a rubber material, may yet be attached to the stamp plate carrier by means of a plug-in type connection via an appropriate snug fit or friction fit, optionally also by utilizing snap-in or latch-in effects, such that it is sufficiently securely connected with the stamp plate carrier for normal use of the stamp, that is despite the movable stamp unit arrangement; the stamp plate may simply be connected with the stamp plate carrier by insertion or pushing in, the desired compact unit being possible, and it may also be manually removed from the stamp plate carrier by releasing this plug connection again.

For this plug-in connection, male connecting elements may be provided at the rim of the stamp plate, e.g. in the form of ledge-shaped or knob-shaped rim projections engaging in or under an overhanging, raised rim portion of the hand stamp. For a particularly simple design of stamp plate and stamp plate carrier and for readily attaching or removing the stamp plate, it has, however, proved particularly suitable if the stamp plate comprises at least one male projection at its rear side facing the stamp plate carrier which is accommodated in a corresponding recess in the stamp plate carrier by a snug fit.

As has already been indicated above, it is particularly advantageous for the plug-in connection which provides for a releasable attachment of the stamp plate on the stamp plate carrier primarily by utilizing a frictional effect, if the stamp plate consists of a rubber material that is soft-elastic as compared to the material of the stamp plate carrier. Preferably, the stamp plate then is of a rubber, such as caoutchouc based on NR (isoprene caoutchouc) and/or butadiene-acrylonitrile caoutchouc. A composite stamp plate assembled of two layers is particularly preferred, which comprises a softer caoutchouc material, e.g. one having a Shore hardness of approximately 60, on its printing side, and a harder caoutchouc material, in particular having a Shore hardness of approximately 85, on its rear side (on the side of the male projection).

The stamp plate carrier as such may also be made of metal, yet preferably it is made of a hard synthetic material, such as, e.g., ABS synthetic material or the like synthetic material.

Particularly with the above-indicated pair of material, rubber/hard synthetic material, the male projection may be substantially knob-shaped, and if it is accommodated in the recess of the stamp plate carrier with slightly excessive dimension, it will thus, as a consequence of friction, not only prevent an undesired release of the stamp plate, but, in case only a single male projection is present, it will also sufficiently safely prevent rotation of the stamp plate on the stamp plate carrier. Thus it is possible and also suitable for reasons of production, if the male projection is of generally cylindrical configuration.

To facilitate insertion of the stamp plate in the stamp plate carrier, it is furthermore advantageous if the male projection is rounded or bevelled or tipped at its free rear end facing away from the stamp plate. There, it is also suitable if the recess at its front side facing the stamp plate has a chamfered rim to form an inlet bevel.

To achieve a certain latching or snapping action when inserting the male projection into the recess, it is furthermore also advantageous if the male projection is, e.g. bead-like, thickened in the region of its free rear end facing away from the stamp plate.

Of course, the respective male projection must not fit so tightly in the associated recess that the male projection will be torn off when detaching the stamp plate therefrom; insofar the dimensions are preferably chosen such—depending on the materials of the components—that the male projection, if at all, is only slightly deformed when being inserted in the recess.

The recess in the stamp plate carrier may simply be formed by an aperture extending through the latter or through its plate-shaped head, respectively. Such a configuration also is particularly advantageous if the male projection, as mentioned before, is thickened at its free rear end, this thickened rear end then projecting outwardly from the rear side of the plate-shaped stamp plate carrier and abutting on the rim of the aperture to attain a type of snap connection. There, the aperture may be substantially formed by a simple, straight bore.

On the other hand, in case the stamp plate carriers have combined printing blocks, in particular in combination with printing character wheels, e.g., for adjusting a date, wherein a sufficiently stable and large stamp plate carrier has to be provided, it may be suitable if the recess is formed by an indentation provided on the front side of the stamp plate carrier. In this instance, the indentation may be inwardly straight so that the male projection is held therein by a mere frictional fit, it may, however, also be slightly widening inwardly in cross-section so that due to the elastic deformation of the soft elastic material of the male projection, again a type of snapping in and positive locking is attained.

The present invention is particularly suited for self-inking stamps intended for printing initials, and which, in particular, have a smaller total cross-section and thus can be put into the pocket of a jacket like a writing tool. In this instance it is suitable if the stamp plate is of generally circular or square configuration and has merely one centrally arranged male projection at its rear side.

On the other hand, for stamping longer words, such as "received" or "mailed" etc., it may also be advantageous if the stamp plate is elongate, e.g. rectangular, strip-shaped or oval, and has at least two mutually spaced male projections over its longitudinal extension.

It is furthermore suitable if the male projections are arranged asymmetrically as an orientation aid when attaching the stamp plate on the stamp plate carrier. It is, of course, also possible to provide the male projections symmetrically so that the production of both the stamp plate and also of the hand stamp is facilitated in this respect.

In accordance with the previous discussion, a particularly advantageous embodiment of the stamp plate according to the invention is characterised in that the plug-in connection element is formed by an e.g. knob-shaped or cylindrical, male projection at the rear side of the stamp plate which faces away from the printing block side. Therein, it is furthermore suitable if the male projection is integrally moulded with the remaining stamp plate of caoutchouc material, such as on the basis of NR (isoprene) caoutchouc and/or butadiene-acrylonitrile caoutchouc. It is also advantageous if the male projection is rounded or bevelled or tipped at its free rear end which faces away from the stamp plate, and/or if the male projection is, e.g. bead-like, thickened in the region of its free rear end which faces away from the stamp plate. Furthermore, advantageously a single male projection may centrally be arranged on the stamp plate which is of generally round to square shape, seen in top view, or there may be at least two male projections provided in mutually spaced relationship on the rear side of the generally elongate or oval stamp plate in the longitudinal direction thereof. There, it is furthermore advantageous if the male projections are asymmetrically arranged as an orientation aid when attaching the stamp plate on the stamp plate carrier.

As has already been mentioned in the introductory portion, the invention is aimed at providing a set of stamp plates in a sales shop or at the user's, too, so that the desired stamp plate may be chosen, as required, and attached in the respective self-inking stamp on the stamp plate carrier. Accordingly, a stamp plate set according to the invention comprising a plurality of stamp plates includes a plug-in holder, in particular a plug-in plate, having a plurality of mutually spaced apart recesses for accommodating the male projections of the stamp plates. Thus, in this stamp plate set a corresponding plug-in system provided for the connection stamp plate/stamp plate carrier is utilized for the releasable retention of the stamp plates in a plug-in holder so that on the whole a safe, yet releasable attachment of the stamp plates is enabled in a neat grouping. The plug-in holder or the stamp plate, respectively, may be housed in a cassette-shaped case, e.g., yet the plate may also be a larger one in a sales-shop and may, e.g., be removably stored in a show case. Like the stamp plate carrier, the plug-in holder or the plug-in plate, respectively, may be comprised of a hard synthetic material, such as, e.g., ABS synthetic material, so as to attain the suitable soft/hard material pair. Furthermore, also here it is suitable for facilitating insertion of the stamp plates with their male projections into the recesses if each recess is chamfered at the rim of its front side facing the stamp plate so as to form an inlet bevel. To provide for a simple production, it is finally advantageous if each recess is formed by an aperture extending through the plug-in plate.

BRIEF DESCRIPTION OF THE DRAWINGS

The invention will now be explained in more detail by way of preferred exemplary embodiments illustrated in the drawings, to which, however, it is not to be restricted. In detail, in the drawings FIG. 1 shows a schematic view of a self-inking stamp comprising a self-inking device and an inverting mechanism;

FIG. 2 shows a bottom view of this self-inking stamp, the rear side of the stamp plate carrier in its upper at-rest position being visible;

FIGS. 3 and 4 are partly sectioned schematic views of a stamp plate carrier associated with this self-inking stamp and a stamp plate therefor, i.e. prior to connection of these parts (FIG. 3),on the one hand, and in the connected state (FIG. 4), on the other hand;

FIGS. 5 and 6 are a top view and a sectional representation, respectively, of a plug-in plate for attachment of stamp plates according to FIGS. 3 and 4, FIGS. 7 and 8 are a respective top view and a partly sectional illustration of this plug-in plate with stamp plates plugged thereinto;

DETAILED DESCRIPTION OF PREFERRED EMBODIMENTS

Figure 11:
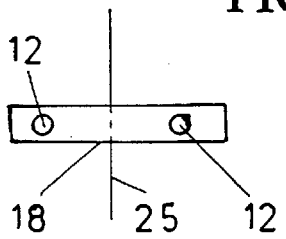
FIG. 11 is an associated bottom view of the stamp plate to illustrate the symmetrically provided male projections.

FIGS. 1 and 2 illustrate partially schematically a self-inking stamp 1 of generally circular cross-section, approximately true to size, which, particularly at present, is considered to be the most preferred embodiment, and which, in a conventional manner known per se thus not requiring any further explanation, is provided with a self-inking device and an inverting mechanism W (such as of the type described in U.S. Pat. No. 4,432,281 A or AT 384,999 B) for a stamp plate carrier 2 inclulding a stamp plate 3. Like the stamp plate 3, the stamp plate carrier 2 is also circular, seen in top view, (cf. also FIG. 7), the stamp plate carrier 2, in the at-rest position shown in FIG. 1 (in which the stamp plate 3 is on top) having downwardly oriented guiding legs 4, laterally projecting studs 5 being furthermore integrally moulded thereto, which cooperate with guide portions of the inverting mechanism W present on the stamp housing 6 or on the handle 7 of the hand stamp 1, respectively, in a conventional manner, as is not further illustrated (cf. e.g., U.S. Pat. No. 4,432,281 A or AT 384,999 B, respectively).

As is particularly apparent from FIGS. 3 and 4, a stiffening strut 8 can extend between the two guiding legs 4 at the lower side of the stamp plate carrier 2; this stiffening strut 8 is centrally recessed at its upper end at 9 in alignment with a recess 10 in the form of a through-aperture or bore 11, to thus provide space for accommodating a generally cylindrical male projection 12 integrally moulded to the lower side of the stamp plate 3, opposite its printing block side 13. The aperture 11 in the stamp plate carrier 2 is bevelled or chamfered at its upper side thereby forming an inlet bevel 14, whereby also space is made available for the material in the somewhat larger cross-section at the transition of the male projection 12 to the stamp plate 3 as such, as is particularly apparent in the illustrations of FIGS. 3 and 4.

In the assembled position according to FIG. 4, the male projection 12 is frictionally seated in the aperture 11, the frictional engagement surprisingly sufficing to securely retain the stamp plate 3 on the stamp plate carrier 2 also during the downward and inversion movement during stamping and to secure it against falling off, and also to prevent rotation of the stamp plate 3 about the geometric vertical axis defined by the male projection 12 and the aperture 11, respectively.

From FIGS. 5 to 8 it is apparent how a plurality of stamp plates 3 in well-arranged assortment is selectably or exchangeably storable for such a self-inking stamp according to FIGS. 1 and 2. In detail, a plug-in holder 14 is provided therefor, which is to have plate-shaped configuration in the present exemplary embodiment, and thus will be termed plug-in plate 15. This plug-in plate 15 is provided with recesses 16 in the form of through-apertures 17, arranged in lines and columns spaced from one another, corresponding to the size of the stamp plates 3 so as to be able to receive the various stamp plates 3 by aid of the male projections 12 which will be plugged into the apertures 17, cf. in particular FIGS. 7 and 8. Again, the upper rims of the apertures or bores 17 may be bevelled, as is indicated at 14' in FIG. 6.

Figure 10:
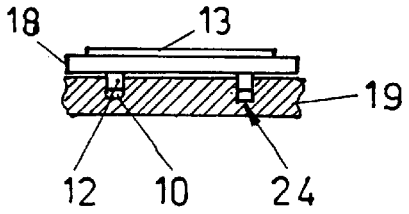
FIG. 10 is a partially sectioned partial representation of such a strip-shaped stamp plate.
Figure 9:
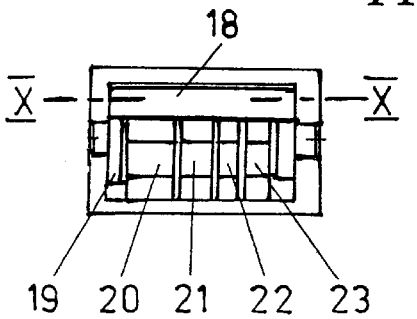
FIG. 9 is a bottom view of a different self-inking stamp, in which a strip-shaped stamp plate is combined with printing characters mounted on type bands.

From FIGS. 9 and 10, an embodiment is apparent in which a strip-shaped, elongate rectangular stamp plate 18 is detachably fastened to a modified stamp plate carrier 19 in the manner indicated, via plug-in connecting elements in the form of male projections 12. In this case, the stamp plate carrier 19 not only serves to support the indicated stamp plate 18, but also to support the printing character bands 20, 21, 22 and 23, cf. FIG. 9, which are tensioned over the stamp plate carrier 19 at the respective sites, similar to the manner illustrated in AT 384,999 B. In this exemplary embodiment, the recesses 10 are formed by pocket-bore-type indentations 24 in the stamp plate carrier 19, two such indentations 24 being provided to receive two spaced-apart male projections 12 at the rear side of the stamp plate 18 facing away from the printing block side 13, cf. FIG. 10. As furthermore apparent from FIG. 11, which shows the lower side or rear side of the stamp plate 18 according to FIGS. 9 and 10, the male projections 12 are symmetrical relative to a center line 25. This facilitates the production of both, the stamp plate 18 and the stamp plate carrier 19 (with the appropriate symmetrical recesses 10).

Figure 12:
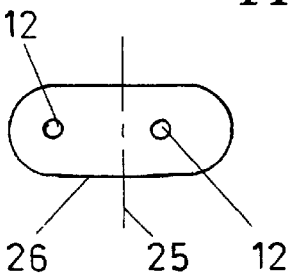
FIG. 12 is a bottom view of a different, i.e. elongate oval, stamp plate, illustrating an asymmetrical provision of two male projections.

The male projections 12 may, however, also be arranged asymmetrical relative to the above-mentioned central line 25, as is apparent from FIG. 12, to provide an orientation aid for the proper plugging in of the stamp plate on the associated stamp plate carrier (not illustrated). Besides, in FIG. 12 the stamp plate 26 is elongate and oval (seen in top view).

Figure 13:
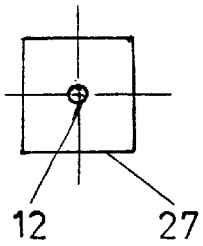
FIG. 13 is a bottom view of a further stamp plate, here of square shape.

In contrast thereto, the stamp plate 27, viewed from below in FIG. 13, is square and has a single, central male projection 12.

Figure 14:
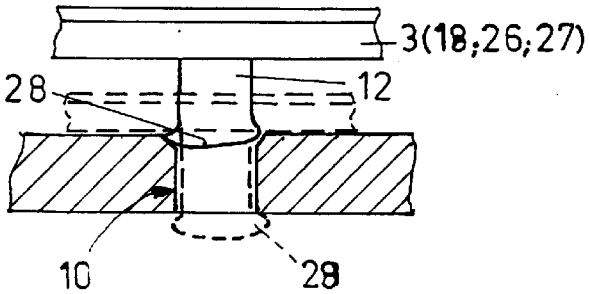
FIG. 14 is an enlarged partially sectioned view of a detail illustrating the plug-in procedure when attaching a stamp plate by plugging the male projection into a recess of the stamp plate carrier.

From FIG. 14 it is finally apparent that the respective male projection 12 may be rounded (or also tipped) at its free end 28 facing away from the stamp plate (3 or 18, 26 or 27, respectively) and may, e.g., have a bead-like thickened portion on this end 28, to provide for an easier insertion of the male projection 12 in the recess 10, on the one hand, and, for a snapping in or latching in of the completely inserted male projection 12 on the stamp plate carrier 2 (or 19, respectively), on the other hand, as illustrated in broken lines in FIG. 14.

Preferably, the stamp plates consist of a rubber material, such as, e.g., caoutchouc on the basis of NR (isoprene)-caoutchouc, or butadiene-acrylonitrile, respectively, whereas the stamp plate carrier is made of steel or, preferably, of a hard synthetic material, such as, e.g., ABS (acrylonitrile-butadiene-styrene) synthetic material or a similar material. Particularly preferred are composite stamp plates 3 made of a softer caoutchouc material (e.g. NR caoutchouc of approximately 60 Shore) on their front side (printing side), and of a harder caoutchouc material (e.g., butadiene-acrylonitrile caoutchouc) of approximately 85 Shore, on their rear side (i.e. on the side of the male projection 12).

Other than in the embodiments illustrated and described, it would, of course, also be possible to vary the number and positions of the respective male projections 12, e.g. to provide three male projections corresponding to the corner points of an isosceles triangle in the embodiment according to FIGS. 3 and 4, instead of the one, central male projection 12. As such, it would also be conceivable to provide male connecting elements on the peripheral rim of the stamp plates, in the region of or adjacent the rear side of these stamp plates, cooperating with corresponding lateral indentations in an e.g. generally tub-shaped upper side of the stamp plate carrier 2 to thus achieve the desired plug-in connection between stamp plate and stamp plate carrier.

The plug-in plate 15 may also be replaced by a block-shaped plug-in holder 14 of, e.g., circular or oval shape, seen in top view. Quite generally, the plug-in holder 14 may form an insert in a container or housing not shown, or constitute a part (e.g. the bottom) of such a container or housing, respectively.

What is claimed is:

1. A self-inking stamp in combination with a stamp plate set comprising (a) a self-inking device, (b) an inverting mechanism, (c) a movable stamp plate carrier coupled to the inverting mechanism, including at least one hole, (d) and a stamp plate set said stamp plate set comprising a plurality of stamp plates, each having a rear side facing the stamp plate carrier in a mounted state, and each including at least one male projection, and a plug-in holder having a plurality of spaced-apart holes to releasably receive said at least one male projection of each of said stamp plates for frictionally connecting each of said stamp plates with said plug-in holder, and wherein one or more stamp plates from said stamp plate set may be selected and mounted to said stamp plate carrier by insertion of the male projection into the at least one hole of the stamp plate carrier.

2. A self-inking stamp as set forth in claim 1, wherein said stamp plate carrier is made of a certain material and said stamp plate is made of a rubber material which is soft-elastic as compared to said certain material of said stamp plate carrier.

3. A self-inking stamp as set forth in claim 2, wherein said stamp plate is made of a caoutchouc material.

4. A self-inking stamp as set forth in claim 3, wherein said caoutchouc material of said stamp plate is based on at least one material selected from the group consisting of NR (isoprene) caoutchouc and butadiene-acrylonitrile caoutchouc.

5. A self-inking stamp as set forth in claim 2, wherein said certain material of said stamp plate carrier is a hard synthetic material.

6. A self-inking stamp as set forth in claim 5, wherein said hard synthetic material is ABS synthetic material.

7. A self-inking stamp as set forth in claim 1, wherein said male projection of said stamp plate has a generally cylindrical configuration.

8. A self-inking stamp as set forth in claim 1, wherein said male projection of said stamp plate has a free rear end facing away from said stamp plate, said free rear end having a rounded, bevelled and tipped configuration.

9. A self-inking stamp as set forth in claim 1, wherein said hole in said stamp plate carrier has a front side facing said stamp plate, said front side having a chamfered rim so as to form an inlet bevel.

10. A self-inking stamp as set forth in claim 1, wherein said male projection of said stamp plate has a free rear end region facing away from said stamp plate, said male projection including a thickened portion in said free rear end region.

11. A self-inking stamp as set forth in claim 10, wherein said thickened portion of said at least one male projection is bead-shaped.

12. A self-inking stamp as set forth in claim 1, wherein said stamp plate carrier is substantially plate-shaped and said hole in said stamp plate carrier is an aperture extending through said plate-shaped stamp plate carrier.

13. A self-inking stamp as set forth in claim 1, wherein said stamp plate carrier has a front side and said hole is formed by an indentation provided in said stamp plate carrier on said front side thereof.

14. A self-inking stamp as set forth in claim 1, wherein said stamp plate has a generally circular or square configuration and said male projection is provided centrally on said stamp plate rear side.

15. A self-inking stamp as set forth in claim 1, wherein said stamp plate is elongate and wherein two male projections are provided, said two male projections being spaced longitudinally from each other over said stamp plate rear side.

16. A self-inking stamp as set forth in claim 15, wherein said elongate stamp plate is rectangular or oval.

17. A self-inking stamp as set forth in claim 15, wherein said two male projections are asymmetrically arranged on said stamp plate as an orientation aid when said stamp plate is attached to said stamp plate carrier.

18. A self-inking stamp as set forth in claim 1, wherein said stamp plate has a printing block side and a rear side facing away from said printing block side, said at least one plug-in connection element being formed by at least one male projection provided on said stamp plate rear side.

19. A self-inking stamp as set forth in claim 18, wherein said at least one male projection is knob-shaped.

20. A self-inking stamp as set forth in claim 18, wherein said at least one male projection is cylindrical.

21. A self-inking stamp as set forth in claim 18, wherein said at least one male projection is integrally moulded with said remaining stamp plate and is made of a caoutchouc material.

22. A self-inking stamp as set forth in claim 21, wherein said caoutchouc material of said stamp plate is based on at least one material selected from the group consisting of NR (isoprene) caoutchouc and butadiene-acrylonitrile caoutchouc.

23. A self-inking stamp as set forth in claim 18, wherein said at least one male projection of said stamp plate has a free rear end facing away from said stamp plate, said free rear end having one of a rounded, bevelled and tipped configuration.

24. A self-inking stamp as set forth in claim 18, wherein said at least one male projection of said stamp plate has a free rear end region facing away from said stamp plate, said at least one male projection including a thickened portion in said free rear end region.

25. A self-inking stamp as set forth in claim 24, wherein said thickened portion of said at least one male projection is bead-shaped.

26. A self-inking stamp as set forth in claim 18, wherein said at least one male projection is a single male projection centrally arranged on the stamp plate, said stamp plate having a generally round or square shape, seen in top view.

27. A self-inking stamp as set forth in claim 18, wherein at least two male projections are provided, said at least two male projections being spaced longitudinally from each other over said stamp plate rear side.

28. A self-inking stamp as set forth in claim 27, wherein said stamp plate is generally rectangular or oval.

29. A self-inking stamp as set forth in claim 27, wherein said at least two male projections are asymmetrically arranged on said stamp plate as an orientation aid when said stamp plate is attached to said stamp plate carrier.

30. A self-inking stamp set as set forth in claim 1, wherein said plug-in holder is a plug-in plate.

31. A self-inking stamp set as set forth in claim 1, wherein said plug-in holder is made of hard synthetic material.

32. A self-inking stamp set as set forth in claim 31, wherein said hard synthetic material is ABS synthetic material.

33. A self-inking stamp set as set forth in claim 1, wherein each hole of said plug-in holder has a front side facing the associated stamp plate, and each hole of said plug-in holder has a chamfered rim on said front side so as to form an inlet bevel.

34. A self-inking stamp set as set forth in claim 1, wherein each hole of said plug-in holder is formed by an aperture extending through said plug-in holder designed as a plug-in plate.

* * * * *